United States Patent [19]

Buckshaw et al.

[11] Patent Number: 4,736,472

[45] Date of Patent: Apr. 12, 1988

[54] TOILET SEAT LATCH

[76] Inventors: Dennis J. Buckshaw, 9610 Melrose, Livonia, Mich. 48154; James A. Clark, 7309 Manner Cir., Apt. 202, Westland, Mich. 48185

[21] Appl. No.: 759,143

[22] Filed: Jul. 26, 1985

Related U.S. Application Data

[63] Continuation-in-part of Ser. No. 535,934, Sep. 26, 1983, abandoned.

[51] Int. Cl.[4] ..... A47K 13/24

[52] U.S. Cl. ..... 4/253; 292/210

[58] Field of Search ..... 4/251, 253; 292/108, 292/210

[56] References Cited

U.S. PATENT DOCUMENTS

| | | | |
|---|---|---|---|
| 392,297 | 11/1888 | White | 292/108 X |
| 1,961,904 | 6/1934 | Meyer | 292/210 X |
| 2,698,439 | 1/1955 | Bruckner | 4/253 |
| 3,024,472 | 3/1962 | Hardenbrook | 4/253 |
| 3,431,004 | 3/1969 | Schell | 4/253 X |

FOREIGN PATENT DOCUMENTS

| | | | |
|---|---|---|---|
| 303703 | 1/1929 | United Kingdom | 4/253 |

*Primary Examiner*—Charles E. Phillips
*Attorney, Agent, or Firm*—Krass & Young

[57] ABSTRACT

A latch mechanism for a hinged cover such as a toilet cover comprising a base which is mounted on the bowl of the toilet, a latch bar which is pivotally mounted on the base and movable between a horizontal position which interferringly overlies as the toilet cover and a raised position which permits raising of the cover, and locking means which must be released to allow the latch bar to be moved to its raised or entry-authorized position. In one embodiment of the invention, the base is mounted on the ceramic structure of the toilet between the cover and the water closet, and the locking means comprises an element which depends pivotally from the latch bar and has dog-leg portions with feet which swing under a portion of the base to prevent the latch bar from being raised. In another embodiment, the base element comprises a U-shaped assembly which fits over the rim of the bowl, and the locking means comprise a pair of independently actuable lock members which are pivoted at one end to the base assembly and engage at their free hook end with recesses in the latch bar to preclude unauthorized raising of the latch bar. In both embodiments, when the latch bar is lowered, it automatically relocks under the influence of gravity.

5 Claims, 5 Drawing Sheets

TOILET SEAT LATCH

RELATED APPLICATION

This application is a continuation-in-part of U.S. patent application Ser. No. 535,934 filed Sept. 26, 1983, now abandoned.

FIELD OF THE INVENTION

This invention relates to a releasable latch means for impeding or preventing the opening of a hinged cover such as a toilet seat/cover.

BACKGROUND OF THE INVENTION

It is generally known that small children will occasionally make unauthorized, unsupervised and undesirable entry into a common household toilet presumably for the purpose of gaining access to the standing water therein. Several devices have been proposed to prevent such unauthorized access to the toilet. However, none of these prior art devices have achieved any significant acceptance in the marketplace, either because they are ineffective in preventing entry into the toilet; they are unduly expensive to manufacture; they are unduly complicated in their operation so as to make even ordinary use of the toilet by adults inconvenient; or they are not suitable for retrofitting to existing toilet facilities.

SUMMARY OF THE INVENTION

The present invention provides a latching device which is conveniently and easily associated with a hinged cover such as a common household toilet cover on a retrofit basis to impede or prevent small children from raising the toilet cover to access the water in the toilet. In addition, the subject invention is extremely easy to release and requires very little maintenance.

In general, the invention comprises a base which may be secured to the toilet bowl, and a latch bar which is connected to the base so as to be pivotal between a locking position in which it overlies and interferes with the raising of the toilet cover, and a released position in which it allows the toilet cover to be raised. The invention further comprises means for releasably securing the latch bar in the locking position.

In one form of the invention, the releasable securing means is pivotally connected to the latch bar at a point adjacent but spaced from the pivotal connection between the latch bar and the base and is positioned in interferring relationship with a portion of the base when the latch bar is in its latching position to preclude raising of the latch bar and thereby preclude unauthorized raising of the cover except upon release of the releasable locking means. In this form of the invention, the base element is adapted to be mounted on the base of the toilet between the cover and the water closet of the toilet and the releasable locking means comprises a latch member which depends pivotally and freely from the latch bar into interferring relationship with a portion of the base.

In this form of the invention, the base is secured to the toilet bowl through the use of the same set of fasteners which secure the seat and cover combination to the bowl. The releasable locking system is effectively gravity operated so as to require no springs or other mechanisms requiring maintenance or cleaning, the gravity operation being such as to releasably lock the latch bar in the entry preventing position whenever it is lowered but being susceptible of extremely simple and easy manipulation by an adult or older child to release the latch bar and permit normal raising of the toilet cover.

In a further form of the invention, the releasable locking means is pivotally secured to the base element and extends into interferring relationship with coacting portions of the latch bar. In this form, the base element is U-shaped and is adapted to sit in inverted fashion over the rim of the bowl of the toilet and the locking means comprises a latching hook which is pivotally mounted on the base element adjacent the outer edge of the rim of the bowl and which latchingly coacts with a recess on the latch bar to maintain the latch bar in its lowered, locking position. In the disclosed embodiment of this form, the latching hook includes a journal portion, a hook portion, and a handle portion spaced axially on the journal portion from the hook portion. The journal portion of the latching hook is pivotally secured to the base member, the hook portion extends from the journal portion for latching coaction with the coacting recess means on the latch bar, and the handle portion is positioned exteriorally of the latch for convenient access by a user so that the handle may be moved readily by the finger of an adult or an older child user to move the hook portion out of engagement with the recess on the latch bar and allow the latch bar to be raised to in turn allow the cover of the toilet to be raised. Preferably, two such latching hooks are provided, the two latching hooks are independently rotatable, and the handle portions of the two independently rotatable latching hooks are positioned on opposite sides of the latch so as to be conveniently accessible by separate fingers of an adult user to allow the two latching hooks to be separately and independently rotated to released positions and allow movement of the latch bar to its raised position.

According to a further feature of this embodiment, the base element includes a main body portion overlying the rim of the toilet, an inner downwardly extending leg portion positioned against the inner surface of the rim, and an outer downwardly extending leg portion positioned adjacent the outer surface of the rim. A separate rim lock member is provided for ratcheting coaction with the inner downwardly extending leg portion of the base member and the rim lock member includes a flange portion which moves into engagement with the under surface of the rim of the bowl to firmly secure the base assembly to the rim.

According to a further feature of the this embodiment, the base assembly further includes a backing plate which is positioned inwardly of the outer downwardly extending leg portion of the base member and includes journal portions which coact with journal portions on the base member to provide the journal means for the latching hooks.

DETAILED DESCRIPTION OF THE INVENTION EMBODIMENTS

Figure 1:
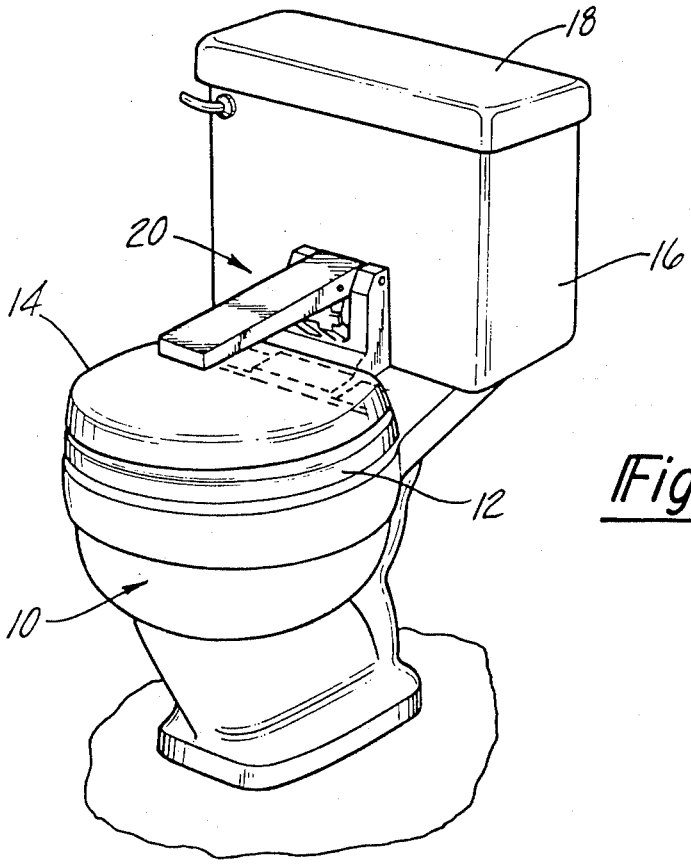
FIG. 1 is a perspective view of a conventional toilet equipped with a first embodiment of the subject invention.

Referring now to the latch embodiment shown in FIGS. 1–4, FIG. 1 shows a conventional toilet comprising a ceramic bowl 10 and having a hinged seat 12 and cover 14 secured thereto. The seat 12 and cover 14 are hinged to the ceramic structure immediately in front of the water closet 16. A cover 18 is provided for the water closet in the conventional fashion.

In accordance with the embodiment of FIGS. 1–4, a releasable latch device 20 is mounted on the ceramic structure of the toilet behind the seat 12 and cover 14, but in front of the water closet 16. The device 20 is effective to prevent the cover 14 from being raised when in the position shown in FIG. 1, but is easily operated by an adult or older child to permit access to the toilet 10 as hereinafter described.

Figure 2:
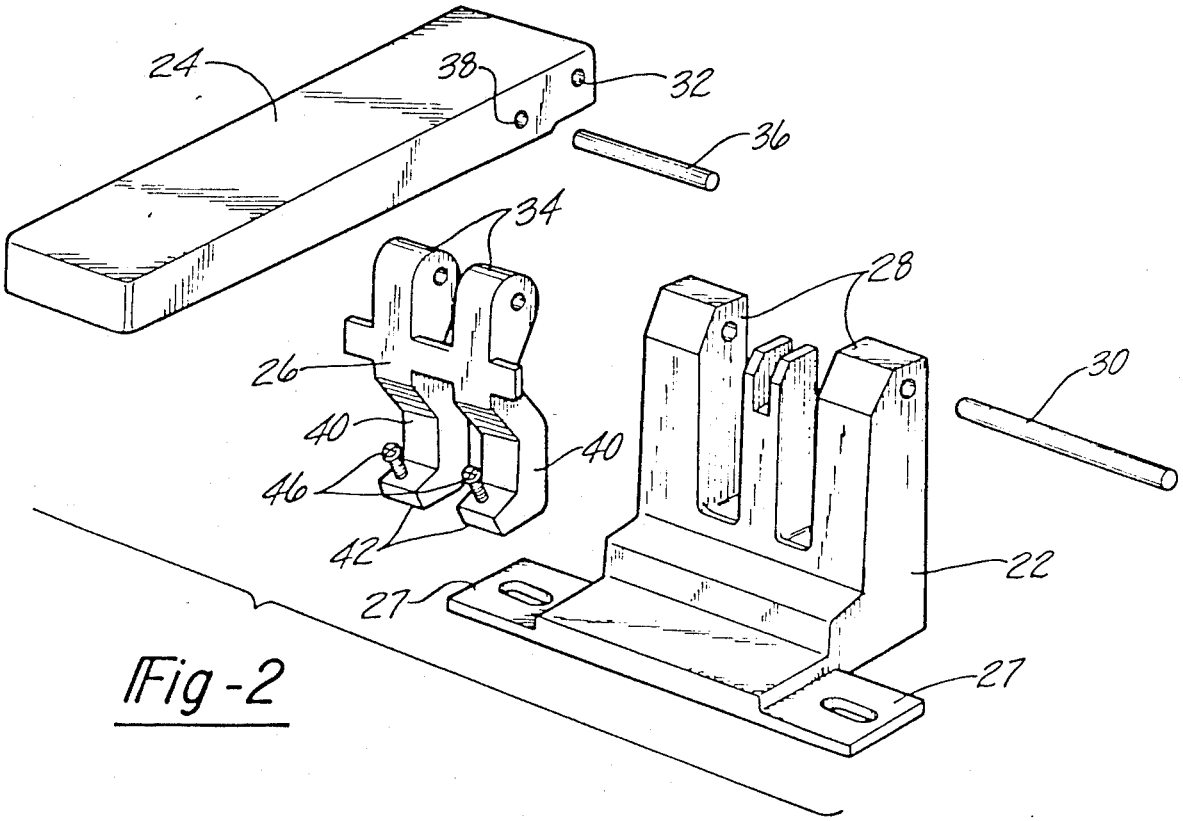
FIG. 2 is an exploded view of the embodiment of FIG. 1.
Figure 3:
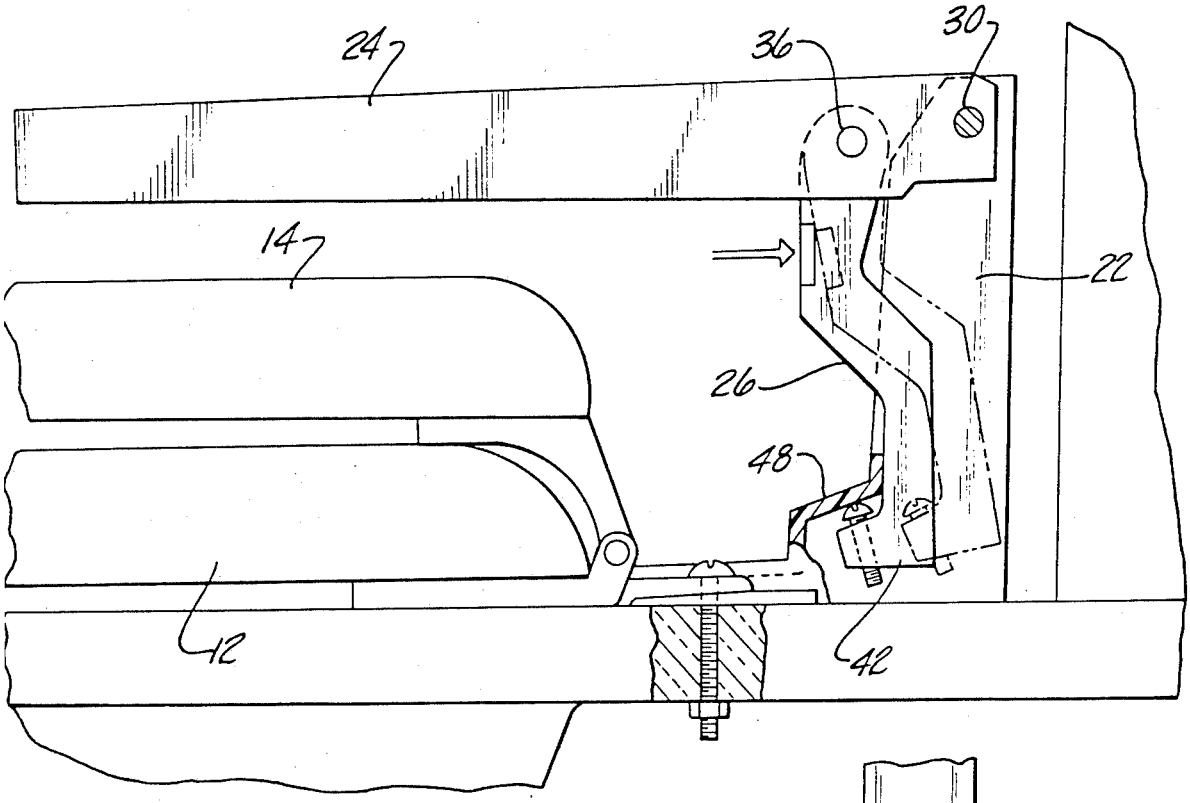
FIG. 3 is a fragmentary side view of the FIG. 1 embodiment with the latch bar in the entry-preventing position.
Figure 4:
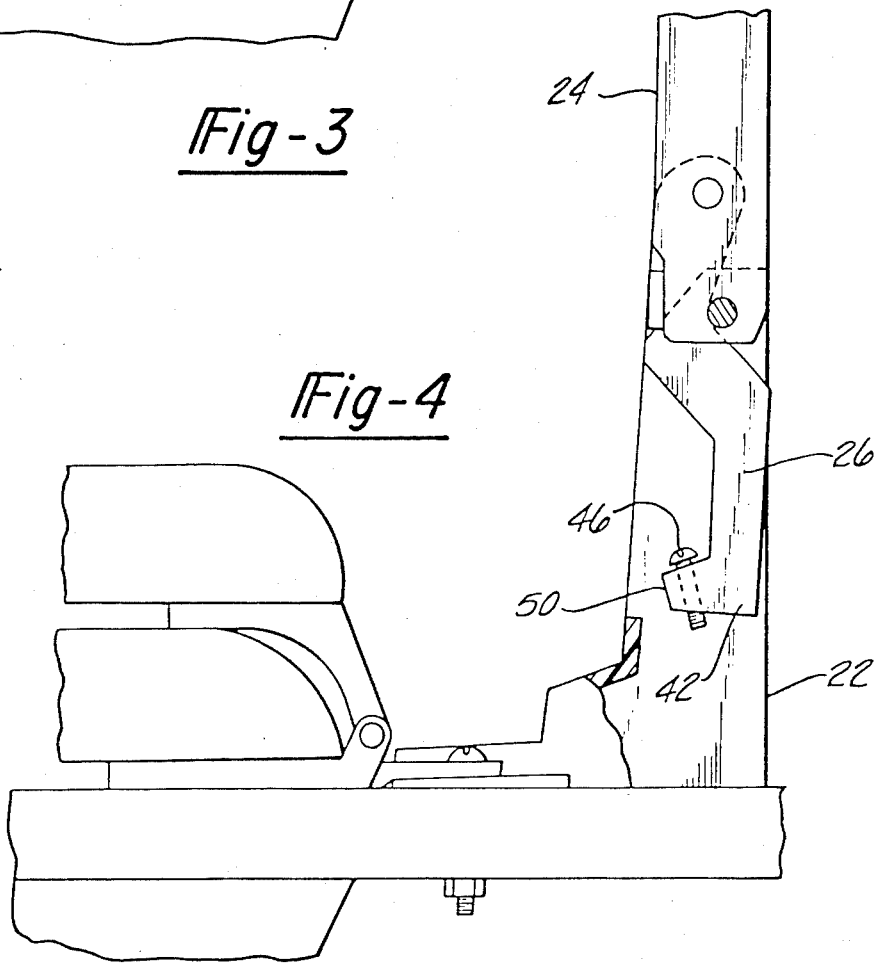
FIG. 4 is a fragmentary side view of the FIG. 1 embodiment with the latch bar in the raised or entry-authorized position.
Figure 5:
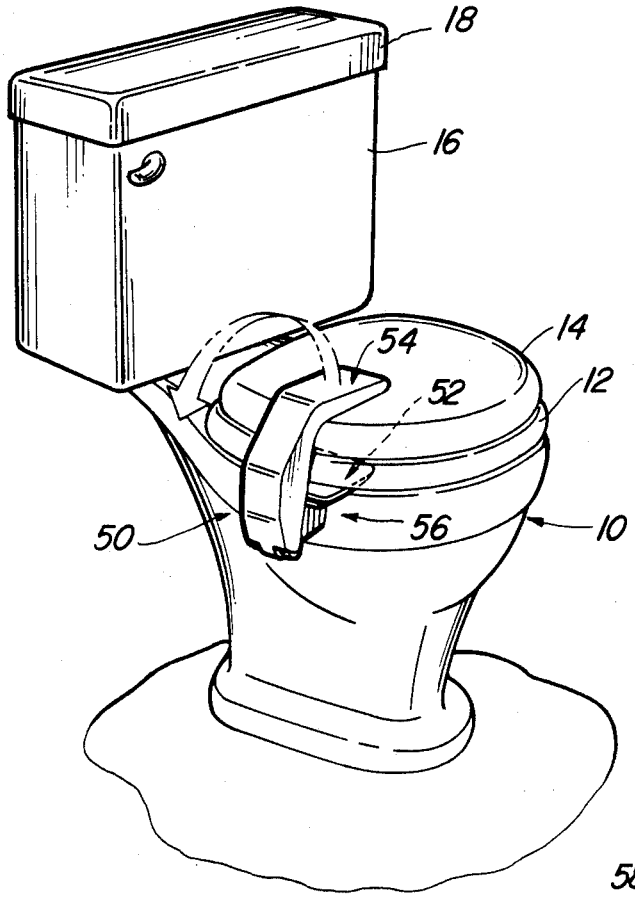
FIG. 5 is a perspective view of a conventional toilet equipped with a second embodiment of the invention.
Figure 9:
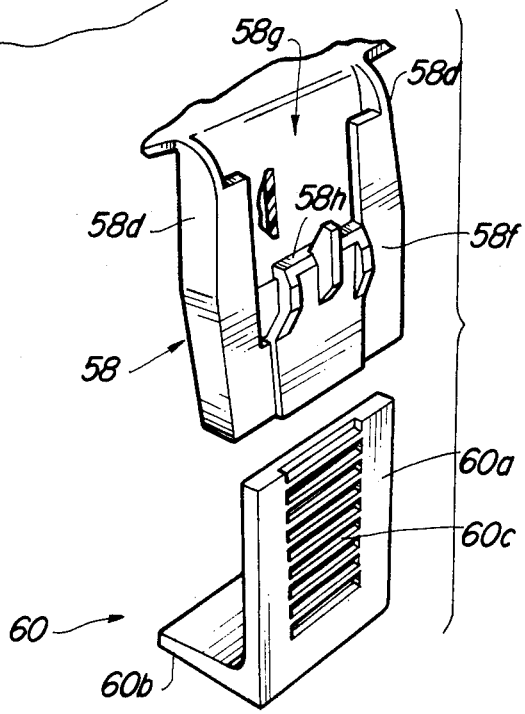
FIG. 9 is a fragmentary view showing details of the base assembly of the FIG. 5 embodiment.
Figure 6:
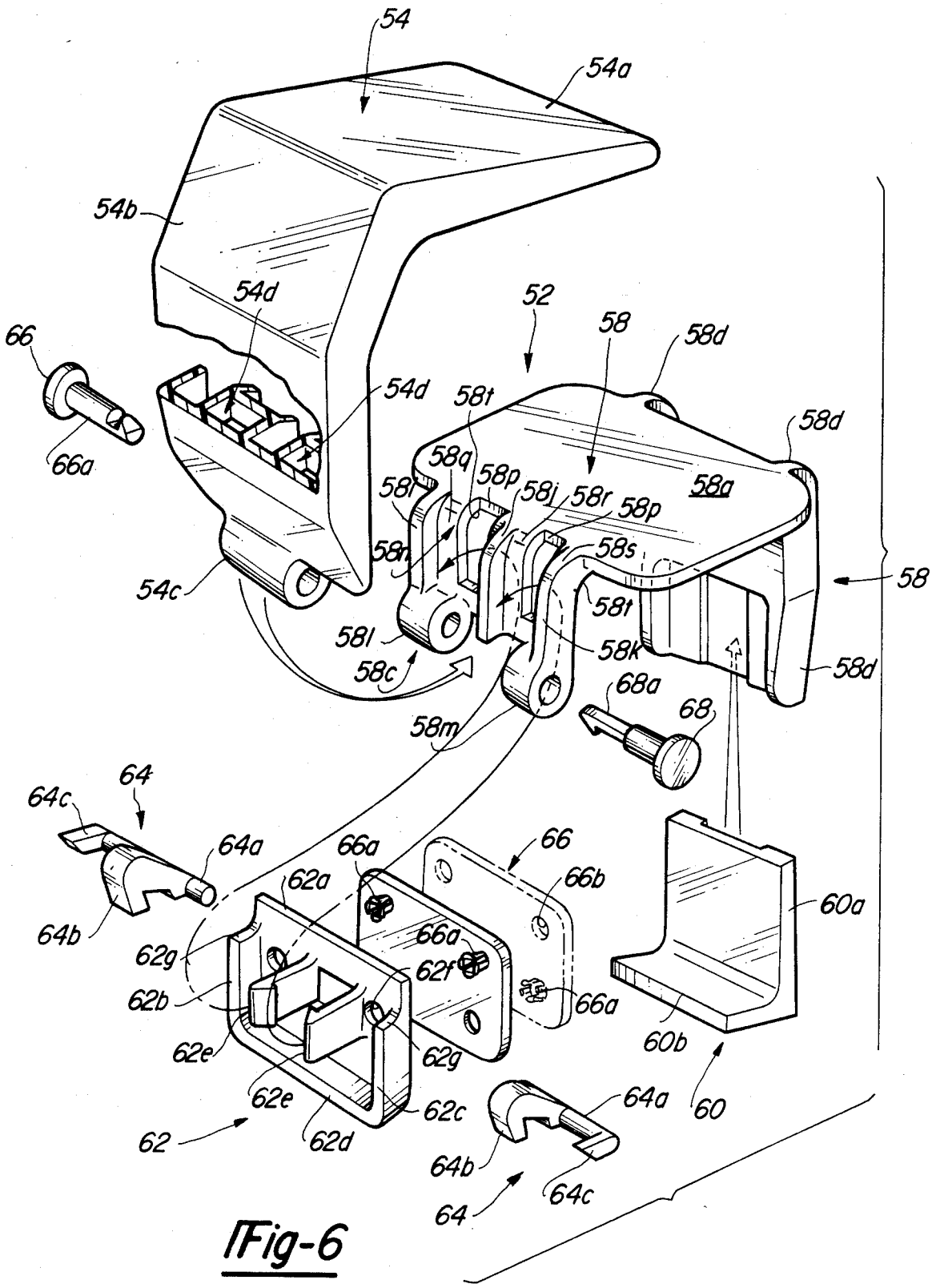
FIG. 6 is an exploded view of the embodiment of FIG. 5.
Figure 7:
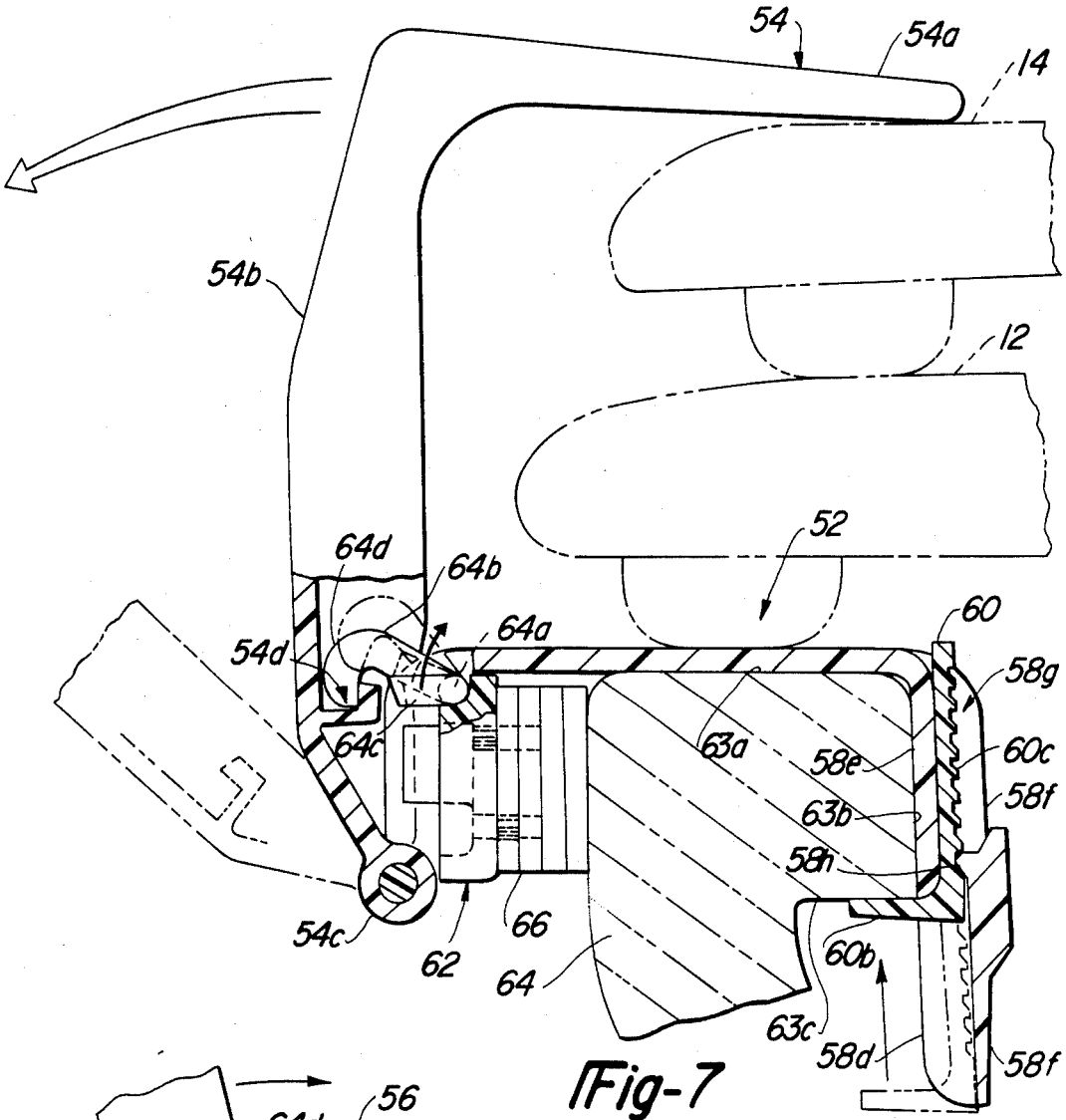
FIG. 7 is a fragmentary side view of the FIG. 5 embodiment with the latch bar in the entry-preventing position.
Figure 8:
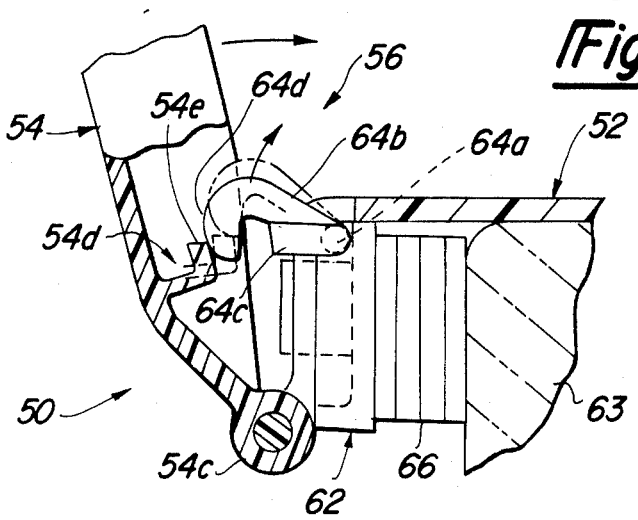
FIG. 8 is a fragmentary side view of the FIG. 5 embodiment with the latch bar in the raised or entry-authorized position.

Looking now particularly to FIGS. 2–4, device 20 is shown to comprise a molded plastic base 22, a beam-type latch bar 24, and a releasable lock means 26 which provides the locking and releasing functions. Base 22 exhibits feet 27 having thin sections to permit the base to be mounted on the ceramic using the same fasteners which hold the seat 12 and cover 14 to the ceramic toilet structure. Base 22 further exhibits a pair of upstanding posts 28 which are molded to receive a hinge pin 30 which passes through a hole 32 in the latch bar 24 whereby the latch bar 24 is pivotally connected to the base 22.

Latch bar 24 is of such size and rigidity as to overlie and prevent normal opening of the cover 14 when in the horizonal position shown in FIG. 3. However, because of the pivotal connection to the base 22 just described, the latch bar 24 may be raised to the vertical position shown in FIG. 4 where it no longer interferes with normal opening and closing of the cover 14.

Lock/release means 26 comprises a pair of fingers 34 which fit internally of the hollowed-out latch bar 24 and are molded to receive a hinge pin 36 which also cooperates with hole 38 in the latch bar 24 to allow pivotal motion of lock means 26 relative to the latch bar 24. It will be noted that the hinge location defined by hole 38 for latch/release means 26 is forward of the hole 32 for the hinge pin 36, a design feature which is instrumental in the operation of lock/release means 26 as hereinafter described.

Lock/release means 26 further comprises dogleg portions 40 having feet 42 which receive adjustable threaded screws 46. As best shown in FIG. 3, the suspension of lock/release means 26 from pin 36 causes the feet 42 to swing under the influence of gravity to a position beneath a substantially horizontal section 48 of the base 22, the heads of the screws 46 being adjustable to just engage the under surface of the substantially horizontal section 48. In this position, i.e., the position shown in FIG. 3, the latch bar 26 may not be raised since to attempt to rotate the latch bar 24 in the clockwise direction results in the heads of the screws 46 being driven against the undersurface of section 48 and this interference quite clearly disallows a lifting of the latch bar 24. With the latch bar 24 in the horizontal position as aforesaid, the cover 14 may not be raised.

By simply pushing the lock/release means 26 rearwardly, i.e., in the direction of the arrow shown in FIG. 3, the feet 42 are brought out from under the section 48 and the latch bar 24 may then be simply raised to the vertical or non-interferring position shown in FIG. 4. Because the pin 36 is ahead of pin 30, this causes the means 26 to be lifted above the section 48 where it may swing freely back and forth with no effect. Whenever the latch bar 24 is again lowered into position, gravity causes the feet 46 of means 26 to immediately swing under the section 48 and relatch the bar 24 in the lowered or horizontal position. The angled front surface 50 on feet 42 ensures a camming action and smooth passage of the feet 42 around the section 48 of base 22 as the bar 24 is being lowered.

As previously mentioned, the device 20 is extremely effective, extremely easy to operate and maintain, requires no springs or rust-prone parts, and may be readily fabricated substantially entirely from plastic. Pivot pins 30 and 36 are preferably made of stainless steel. Moreover, it is easily retrofitted to most existing toilets at little expense and with little effort.

Referring now to the embodiment of FIGS. 5–9, FIG. 5 shows a conventional toilet comprising a ceramic bowl 10 and having a hinged seat 12 and cover 14 secured thereto. The seat 12 and cover 14 are hinged to the ceramic structure immediately in front of the water closet 16. A cover 18 is provided for the water closet in the conventional fashion. A releasable latch device 50 is mounted on the toilet.

Latch device 50, broadly considered, includes a base assembly 52, a latch bar 54, and releasable lock means 56.

Base assembly 52 includes a base member 58, a rim lock member 60, and a backing plate 62.

Base member 58 is U-shaped and includes a main body portion **58*a*, an inner downwardly extending leg portion 58*b*, and an outer downwardly extending leg portion 58*c*. Main body portion 58*a* is generally planar and is adapted to overlie the upper surface 63*a* of the rim 63 of the bowl 10. Leg portion 58*b* is adapted to be positioned adjacent the inner surface 63*b* of the rim portion of the bowl and includes laterally spaced rib portions 58*d*, a main body portion 58*e* positioned between rib portions 58*d* and adapted to be immediately juxtaposed to rim surface 63*b*, a back portion 58*f* spaced from main body portion 58*e* and defining a vertically-extending channel 58*g* therebetween, and a ratchet finger portion 58*h* projecting into channel 58*g***.

Outer downwardly extending leg portion **58*c* includes vertically extending laterally spaced rib portions 58*i,j,k*, journal portions 58*l* and *m* positioned respectively at the lower ends of ribs 58*i* and 58*k*, and a main body portion 58*n* including vertically extending windows 58*p* dividing main body portion 58*n* into vertically extending pillar portions 58*q,r* and *s*** respectively.

Rim lock member 60 is L-shaped and includes an upstanding ratchet portion **60*a* and a vertically extending flange portion 60*b*. Ratchet portion 60*a* includes a plurality of vertically spaced ratchet teeth 60*c* adapted for ratcheting coaction with ratchet finger portion 58*h*** on inner downwardly depending leg portion 58b of base member 58.

Backing plate 62 includes a main body portion 62a, side flange portions 62b and 62c, lower flange portion 62d, laterally spaced horizontally extending prong portions 62e, and laterally spaced holes 62f.

Latch bar 54 is generally L-shaped and includes a main body portion 54a adapted to extend in locking fashion over cover 14 and a crank arm portion 54b. The lower end of crank arm portion 54b is provided with a central journal portion 54c adapted to fit between the journal portions 58l and 58m of base member 58 and the inner face of crank arm 54b is provided with a pair of integrally molded, laterally spaced recesses or pockets 54d.

Locking means 56 comprises a pair of latching hooks 64. Each latching hook 64 includes a journal portion 64a, a hook portion 64b extending radially from the axis of journal portion 64a, and a handle portion 64c extending radially from journal portion 64a at a location thereon spaced axially from hook portion 64b.

The latch device is assembled for distribution by placing journal portion 54c of latch bar 54 between journal portions 58l and 58m of base member 58, and inserting pivot pins 66 and 68 through journal portions 58l and 58m, respectively, so that coacting means 66a and 68a on the inboard ends of pins 66 and 68 latch together to provide a journal to pivotally secure latch bar 54 to the lower end of outer downwardly depending leg portion 58c of base member 58. Latching hooks 56 are now positioned behind downwardly depending leg portion 58c with hook portions 64b extending forwardly through windows 58p and handle portions 64c disposed on the respective outboard sides of the latch, whereafter prong portions 62e of backing plate 62 are passed through windows 58p to snappingly engage the prong portions with opposite vertical edges of central column portion 58r to securely position backing plate 62 behind downwardly depending leg portion 58c with hook portions 64b extending forwardly through windows 58p, handle portions 64c disposed on the respective outboard sides of the latch, and journal portions 62g at the upper ends of flanges 62b and 62c in coacting relation to journal portions 58t defined adjacent the juncture of downwardly depending leg portion 58c of base member 58 and main body portion 58a of base member 58. Journal portions 62g thus coact with journal portions 58t to journal latching hooks 64 for pivotal movement on the base assembly at a location generally adjacent the juncture of downwardly depending leg portion 58c and main body portion 58a of base member 58.

The invention latch package, when sold, includes the thus assembled base assembly and latch bar in combination with rim lock member 60 and a plurality of spacer plates 66. To install the latch on a toilet, the base assembly is positioned over the rim 60 of the toilet, preferably along either lateral side of the bowl; rim lock member 60 is thrust upwardly to slide ratchet portion 60a into channel 58g of leg portion 58b so that ratchet finger portion 58h ratchedly engages successive ratchet teeth 60c on ratchet portion 68a until flange portion 60b seats securely against the under surface 63c of toilet bowl rim 63; and one or more spacer plates 66, depending upon the thickness of rim portion 63, are secured to the rear face of backing plate 62 to provide a proper snug fit for the latch on the rim of the toilet bowl. Spacer plates 66 preferably snappingly join to backing plate 62 and to one another by snapping coaction between pins 66a and holes 62f, 66b.

The invention latch is now ready for use. With latch bar 54 in latching or locking position over cover 14, hook portions 64b of latching hooks 64 are positioned in recesses or pockets 54d on the crank portion 54b of the latch bar so as to preclude raising or upward movement of the latch bar. To allow upward movement of the latch bar and access to the toilet, the handle portion 64c of the independently rotatable latching hooks 64 must be separately engaged by separate fingers of the adult or older child user to rotate the handle portions upwardly and rotate the hook portions 64b out of the recesses 54d whereafter the latch bar can be raised. Following use of the toilet and lowering of the cover 14, the latch bar is lowered to its locking position. As the latch bar approaches the locking position, cam surfaces 54e adjacent pockets 54d and cam surfaces 64d on hook portion 64b cammingly coact to cause the latching hooks to pivot upwardly whereafter hook portion 64b drop downwardly by gravity into recesses 54d as the latch bar element assumes its locking or latched position overlying cover 14.

As with the latch device 20 of the FIGS. 1–4 embodiment, the latch device is extremely effective, easy to operate and maintain, requires no springs or rust-prone parts and may be readily fabricated substantially entirely from plastic. Moreover, it is easily retrofitted to most existing toilets at little expense and with little effort and, because of the necessity of individually releasing each of the latching hooks, the latch of the FIGS. 5–9 embodiment requires a skill and dexterity beyond that of a very small child and yet is easily manipulatable by an older child or an adult.

Whereas preferred embodiments of the invention have been illustrated and described in detail, it will be appreciated that various changes may be made in the disclosed embodiments without departing from the scope or spirit of the invention.

We claim:

1. A toilet seat latch for use with a hinged toilet cover comprising:

(A) a base element adapted to be fitted over and mounted on the rim of the bowl of the toilet;

(B) a latch bar connected to said base element and pivotal between a horizontal position overlying the toilet cover to prevent opening of the cover and a raised position to allow opening of the cover;

(C) a releasable locking member secured to one of said elements and releasably and lockingly engaging the other of said elements; and (D) means for manually moving said locking member to a released position to allow movement of the toilet cover to its raised position to allow opening of the toilet cover;

(E) said locking member comprising a hook member pivotally secured at one end to said base element and releasably and lockingly coacting at its hook end with recess means formed in said latch bar element at a location thereon adjacent to but spaced from the point of pivotal connection of said latch bar element to said base element;

(F) said recess means on said latch bar element and said hook portion of said hook member including coacting cam surfaces which cammingly coact upon movement of said latch bar element from its raised position to its lowered position to move said hook portion into said recess so that said latch bar element is automatically locked upon movement of said latch bar element to its lowered position.

2. A toilet seat latch for use with a hinged toilet cover comprising:

(A) a base element adapted to be fitted over and mounted on the rim of the bowl of the toilet;

(B) a latch bar connected to said base element and pivotal between a horizontal position overlying the toilet cover to prevent opening of the cover and a raised position to allow opening of the cover;

(C) a releasable locking member secured to one of said elements and releasably and lockingly engaging the other of said elements; and (D) means for manually moving said locking member to a released position to allow movement of the toilet cover to its raised position to allow opening of the toilet cover;

(E) said base element comprising a base assembly including (1) a U-shaped base member adapted to fit over the rim of the bowl of the toilet and including a main body portion seated on the upper surface of the rim, an outer downwardly extending leg portion positioned outside of the rim and an inner downwardly extending leg portion positioned adjacent the inner surface of the rim, and (2) a rim lock member adapted for ratcheting locking coaction with said inner downwardly extending leg portion of said base member upon upward movement of said rim lock member relative to said downwardly extending leg portion and including a flange portion adapted to seat under the rim of the toilet bowl upon such upward ratcheting movement.

3. A toilet seat latch according to claim 2 wherein:

F. said latch bar element is pivoted to said base assembly at a location adjacent the lower end of said outer downwardly extending portion of said base member; and G. said releasable locking member comprises a hook member pivoted to said base member at a location generally adjacent the juncture of said main body portion of said base member with said outer downwardly extending leg portion of said base member.

4. A toilet seat latch according to claim 3 wherein:

H. said hook members includes a journal portion; and

I. said base assembly further includes a backing member positionable inside said outer downwardly extending leg portion of said base member and including journal portions which coact with journal portions on said outer downwardly extending leg portion to provide the journal means for receiving the journal portion of said hook member.

5. A toilet seat latch according to claim 4 wherein:

J. said backing member is snappingly secured to said outer downwardly extending leg portion of said base member; and K. said latch further includes spacer plates selectively positionable between said backing member and the outer vertical face of the rim of the toilet bowl to adapt the latch to rims of varying thickness.

* * * * *